United States Patent [19]

Howe

[11] Patent Number: 4,674,552

[45] Date of Patent: Jun. 23, 1987

[54] METHOD OF, AND A FIXTURE FOR, FORMING A CORE FOR A CASTING

[75] Inventor: George C. Howe, Wethersfield, Conn.

[73] Assignee: Terry Corporation, Windsor, Conn.

[21] Appl. No.: 730,520

[22] Filed: May 6, 1985

[51] Int. Cl.[4] ..... B22D 19/00; B22C 13/12

[52] U.S. Cl. ..... 164/11; 164/231; 164/15

[58] Field of Search ..... 164/9, 10, 11, 15, 228, 164/230, 231, 232

[56] References Cited

U.S. PATENT DOCUMENTS 2,097,314 10/1937 Wales ..... 164/11
2,301,140 11/1942 Pfeiffer ..... 164/11

FOREIGN PATENT DOCUMENTS 343754 7/1972 U.S.S.R. ..... 164/231
480486 12/1975 U.S.S.R. ..... 164/231

*Primary Examiner*—Nicholas P. Godici
*Assistant Examiner*—Richard K. Seidel
*Attorney, Agent, or Firm*—B. J. Murphy

[57] ABSTRACT

The method involves the disposition of a pair of walls in separated juxtaposition, to form a space therebetween, the walls having transverse, vane-cross-section shaped apertures formed therein; setting vanes in the apertures, across the space; filling the space with core material for solidification therein; and then separating the walls and vanes from each other after the material has solidified. The fixture provides a pair of walls so apertured, and a platform upon which, removably, to support the walls.

8 Claims, 3 Drawing Figures

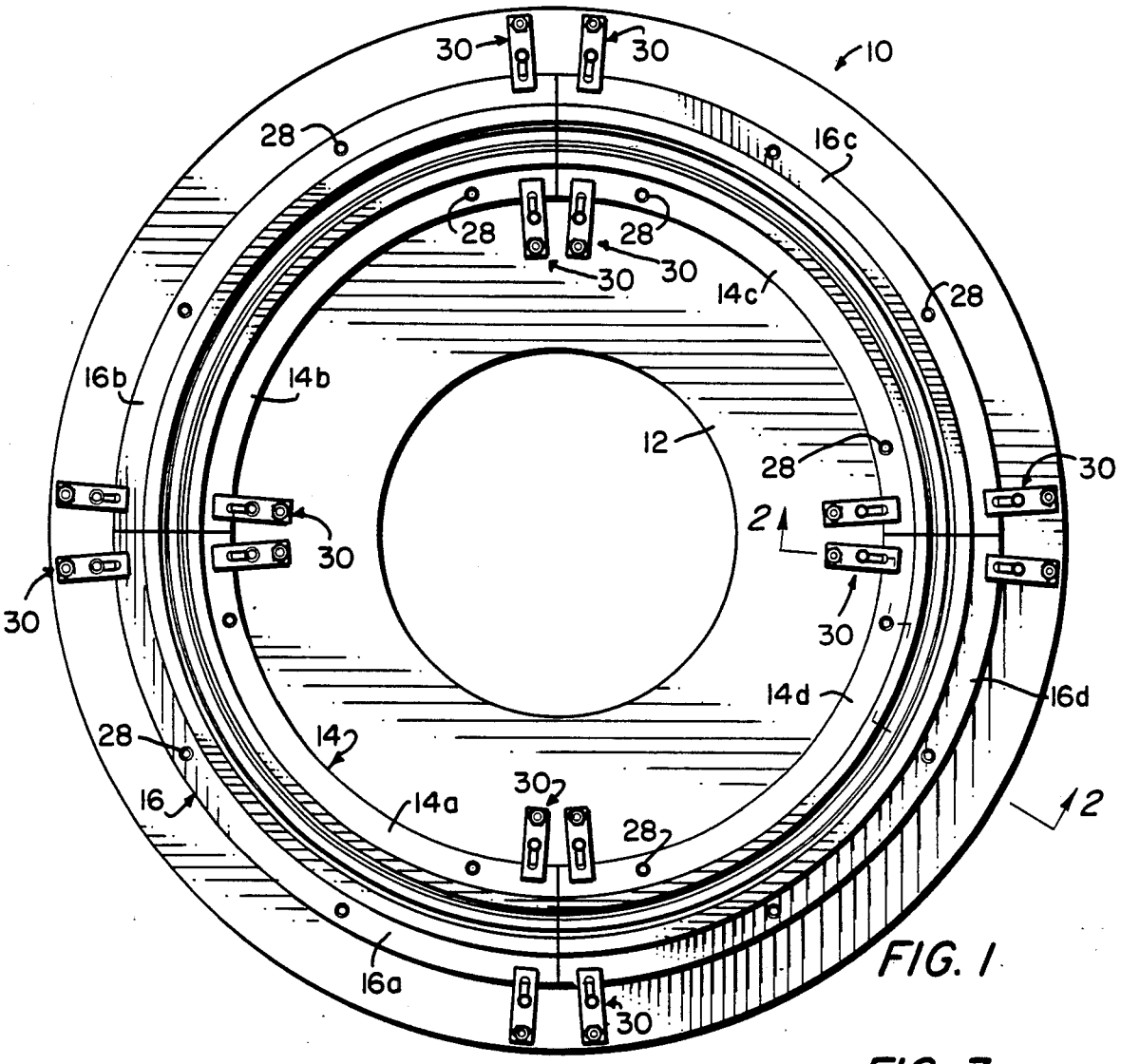
FIG. 1
FIG. 2
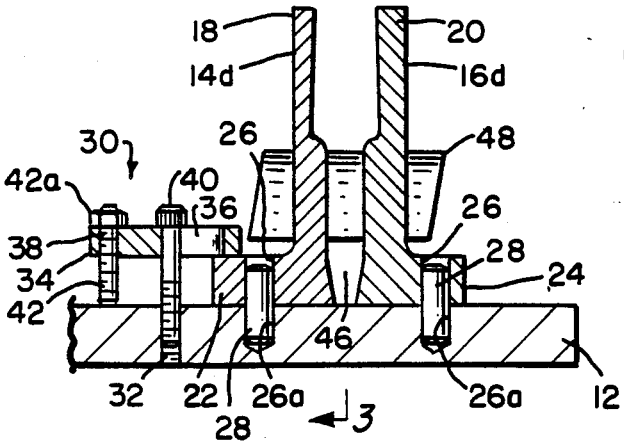
FIG. 3
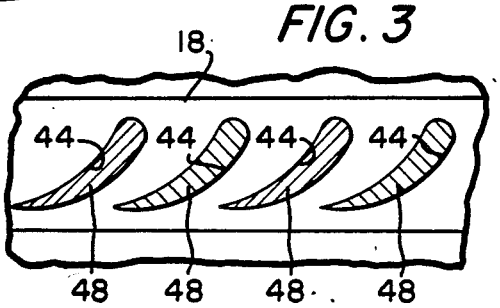

METHOD OF, AND A FIXTURE FOR, FORMING A CORE FOR A CASTING

This invention pertains to methods and fixtures used in the manufacture of steam turbines, gas turbines, and the like, and subassemblies thereof, and in particular to a method of, and a fixture for, forming a core for the casting of a turbine nozzle block from such core.

In the manufacturing of steam turbines, subassemblies called stators, or diaphragms, or nozzle blocks, are required to direct the steam flow to the rotating blades. Usually these nozzle blocks consist of vanes with metal cast around them.

One of the difficulties in producing these subassemblies—these nozzle blocks—is making the sand cores to hold the vanes accurately in place so that the metal will flow around them during the casting process.

It is an object of this invention to set forth a novel method of forming a core, for the casting of a turbine nozzle block therefrom, comprising the steps of forming a pair of walls with apertures of a given, vane-cross-section shape formed in each; disposing the walls in juxtaposition with (a) a space therebetween, and (b) said apertures in one of said walls in alignment, across the space, with said apertures in the other of said walls; setting vanes of said given cross-section shape in said apertures so that (a) said vanes are engaged with both said walls, and (b) bridge across the space; filling the space with core material for solidification of the latter, within the space, into a core; and separating the walls and vanes from each other after the space-filling core material has solidified into a core.

It is also an object of this invention to set forth a fixture, for forming a core, for the casting of a turbine nozzle block from such core, comprising a pair of walls; said walls having apertures of a given vane cross-section shape formed therein; means disposing said walls in juxtaposition, with (a) a space therebetween, and (b) said apertures in one of said walls being in alignment, across said space, with said apertures in the other of said walls; and vanes of said given cross-section shape set in said apertures, in engagement with both said walls, and bridging across said space.

Further objects of this invention, as well as the novel features thereof, will become more apparent by reference to the following description taken in conjunction with the accompanying figures, in which:

FIG. 1 is a plan view of a fixture which embodies the best mode of structure contemplated by the inventor for carrying out his invention;

FIG. 2 is a cross-sectional view, taken along section 2—2 of FIG. 1, to which, however, a vane is added; FIG. 1 shows no vanes. This cross-sectional view is on a scale which is twice that of FIG. 1; and FIG. 3 is a cross-sectional view, taken along section 3—3 of FIG. 2, the same showing a series of vanes.

As shown in the figures, a fixture 10 comprises a platform 12 of annular configuration. The platform 12 provides a support for inner and outer rings 14 and 16, respectively each of which is subdivided into quadrants 14*a* through 14*d*, and 16*a* through 16*d*.

The inner and outer rings 14 and 16 comprise walls 18 and 20 which have mounting flanges 22 and 24 integral therewith. Each flange of each quadrant has two dowel holes 26 formed therein so positioned as to align with mating dowel holes 26*a* formed in the platform 12. The quadrants 14*a*–14*d* and 16*a*–16*d* are set in position upon the platform 12, with the aforesaid dowel holes 26 and 26*a* in alignment, and then locating dowels 28 are set therein.

To secure the quadrants 14*a*–14*d* and 16*a*–16*d* on the platform 12, clamping devices 30 are provided. The platform has sixteen drilled and tapped screw holes 32 formed therein; eight are to accommcdate pairs of clamping devices for each of the quadrants 14*a*–14*d*, and eight are to accommodate pairs of clamping devices for each of the quadrants 16*a*–16*d*. While all the clamping devices 30 are the same, only one is shown in detail in FIG. 2.

Each clamping device 30 comprises a clamp 34 which has a slot 36 and a tapped screw hole 38 formed therein. Cap screws 40 are received in the slots 36 and threaded into the holes 32 to bring ends of the clamps 34 into engagement with the flanges 22 and 24. Then, set screws 42 are threaded into holes 38, and brought to bear upon the platform 12, to forceably lever or tilt the clamps 34 on the cap screws 40 thereby to fasten them rigidly onto the flanges 22 and 24. Lock nuts 42*a* secure the set screws 42.

The quadrants 14*a*–14*d* and 16*a*–16*d* have common, vane-cross-section-shaped apertures 44 formed therein. The apertures 44 are so formed that those in wall 18 (i.e., ring 14 and quadrants 14*a*–14*d* ) are aligned, directly across the intervening space 46 between walls 18 and 20, with the apertures 44 in wall 20 (i.e., ring 16 and quadrants 16*a*–16*d*).

To form a core for a nozzle block, it remains only to set vanes 48 in the apertures 44, bridging across the space 46, then fill the space 46 with core material (i.e., sand and a binder, for instance), allow the space-filling material to solidify, and then separate the vanes 48 from the walls 18 and 20. The latter are separated as follows. The vanes 48 are slid outwardly so that they disengage from wall 18. The clamping devices 30 are removed from the quadrants 14*a*–14*d*. The vanes 48 are next slid inwardly, so that they disengage from wall 20, and the clamping devices 30 are removed from the quadrants 16*a*–16*d*. The vanes 48, then, are centralized in the resulting core, and the whole is ready to be placed into a mold for the casting of a nozzle block.

While I have described my invention in connection with a specific embodiment, and a specific process or method, it is to be clearly understood that this is done only by way of example and not as a limitation to the scope of my invention as set forth in the objects thereof and in the appended claims.

I claim:

1. A method of forming a core, for the casting of a turbine nozzle block therefrom, comprising the steps of:

providing (a) a platform, (b) a pair of walls, (c) fasteners for removably fixing the walls to the platform, (d) vanes, and (e) core material; wherein said walls providing step comprises providing the pair thereof with apertures of a given, vane-cross-section shape formed in each;

disposing the walls in juxtaposition upon, and perpendicular to, the platform, with (a) a space intervening between the walls, and (b) said apertures in one of said walls in alignment, across the space, with said apertures in the other of said walls; wherein said vanes providing step comprises providing vanes of said given, cross-section shape;

setting the vanes in the apertures, so that (a) said vanes are engaged with both said walls, and (b) bridge across the space; wherein said disposing step comprises removably fixing said walls to the platform with the fasteners;

filling the space with core material, and allowing the material to solidify therein; and after the material has solidified sliding the vanes through the core material and out of the apertures in one of the walls;

unfastening and removing the latter wall from the platform;

sliding the vanes through the core material and out of the apertures in the other of the walls;

unfastening and removing the latter wall from the platform; and slidably centralizing the vanes in the core material.

2. A method of forming a core, for the casting of a turbine nozzle block therefrom, comprising the steps of:

providing (a) a platform, (b) a pair of walls, (c) fasteners for removably fixing the walls to the platform, (d) vanes, and (e) core material; wherein said walls providing step comprises providing the pair thereof with apertures of a given, vane-cross-section shape formed in each;

disposing the walls in juxtaposition upon, and perpendicular to, the platform, with (a) a space intervening between the walls, and (b) said apertures in one of said walls in alignment, across the space, with said apertures in the other of said walls; wherein said vanes providing step comprises providing vanes of said given, cross-section shape;

setting the vanes in the apertures, so that (a) said vanes are engaged with both said walls, and (b) bridge across the space; wherein said disposing step comprises removably fixing said walls to the platform with the fasteners;

filling the space with core material, and allowing the material to solidify therein; and after the material has solidfied sliding the vanes through the core material and out of the apertures in the walls;

unfastening and removing the walls from the platform; and slidably centralizing the vanes in the core material.

3. A fixture, for forming a core, for the casting of a turbine nozzle block from such core, comprising;

a pair of walls; and a platform; wherein said walls are disposed in juxtaposition upon, and perpendicular to, the platform, with a space intervening between the walls;

both of said walls have fully bounded apertures of a given, vane-cross-section shape formed therein;

said fully bounded apertures in one of said walls are in alignment, across said space, with said fully bounded apertures in the other of said walls; and further including vanes, of said given, cross-section shape, slidably engaged with said fully bounded apertures in both of said walls and bridging across said space in elevation above said platform; and fasteners having means cooperative with said platform and said walls for removably fastening said walls, externally relative to said space, to said platform; wherein only said walls comprise means for supporting said vanes in elevation above said platform and bridgingly across said space.

4. A fixture, according to claim 3, wherein:

said walls comprise a fully circular, segmented, inner wall, and a fully circular, segmented, outer wall; and said walls are mutually concentric, and said outer wall circumscribes said inner wall.

5. A fixture, according to claim 4, wherein:

said platform closes off an end of said space, and cooperates with said walls to define said space as a trough.

6. A fixture, for forming a core, for the casting of a turbine nozzle block from such core, consisting of:

a platform;

a pair of walls;

fasteners for removably fixing the walls to the platform; and vanes; wherein said walls are disposed in juxtaposition upon, and perpendicular to, the platform, with a space intervening between the walls;

both of said walls have fully bounded apertures of a given, vane-cross-section shape formed therein;

said fully bounded apertures in one of said walls are in alignment, across the space, with said fully bounded apertures in the other of said walls;

said vanes (a) are of said given, cross-section shape, (b) are slidably engaged with said fully bounded apertures in both said walls, and (c) bridge across said space in elevation above said platform; and said fasteners are commonly engaged with said platform and said walls.

7. A fixture, according to claim 6, wherein:

said walls comprise a fully circular, segmented, inner wall, and a fully circular, segmented, outer wall; and said walls are mutually concentric, and said outer wall circumscribes said inner wall.

8. A fixture, according to claim 7, wherein:

said platform closes off an end of said space, and cooperates with said walls to define said space as a trough.

* * * * *